United States Patent [19]

Karaba et al.

[11] 4,031,868

[45] June 28, 1977

[54] VARIABLE COMPRESSION RATIO PISTON

[75] Inventors: Albert M. Karaba, Muskegon; Alexander P. Brouwers, Bloomfield Hills; Thomas J. Pearsall, Grand Haven, all of Mich.

[73] Assignee: Teledyne Industries, Inc., Los Angeles, Calif.

[22] Filed: Feb. 20, 1976

[21] Appl. No.: 659,727

Related U.S. Application Data

[63] Continuation-in-part of Ser. No. 611,863, Sept. 10, 1975.

[52] U.S. Cl. ..... 123/78 B; 123/48 B; 92/82; 92/216

[51] Int. Cl.[2] ..... F02B 75/04

[58] Field of Search ..... 123/78 R, 78 B, 48 R, 123/48 B; 92/82, 216

[56] References Cited

UNITED STATES PATENTS

| | | | |
|---|---|---|---|
| 3,417,738 | 12/1968 | Basiletti et al. | 123/78 B |
| 3,527,264 | 9/1970 | Bachle | 123/78 B |
| 3,667,433 | 6/1972 | Isley | 123/78 B |

*Primary Examiner*—C. J. Husar

*Assistant Examiner*—David D. Reynolds

*Attorney, Agent, or Firm*—Gifford, Chandler, Sheridan & Sprinkle

[57] ABSTRACT

A two part variable compression ratio (VCR) piston assembly having an outer member movable relative to an inner member to vary the compression ratio of an internal combustion engine and a hydraulic system utilizing oil from the lubrication system of the engine for automatically controlling the relative movement of the members to maintain a predetermined maximum combustion chamber pressure. A hydraulic circuit includes an upper and a lower chamber which expands and contracts conversely upon relative movement of the piston members and a system for supplying oil to the upper chamber and to the lower chamber via the upper chamber and for discharging the oil from the upper chamber in a manner which gradually changes the compression ratio of the piston until a predetermined maximum combustion chamber pressure has been achieved and which tends to maintain the maximum combustion chamber pressure after it has been achieved. The lower chamber is disposed adjacent the piston ring area and a sealing ring is utilized as a valve for regulating oil flow from the upper chamber to the lower chamber.

10 Claims, 5 Drawing Figures

VARIABLE COMPRESSION RATIO PISTON

RELATIONSHIP TO OTHER APPLICATIONS

The present application is a continuation-in-part of Application Ser. No. 611,863, filed Sept. 10, 1975.

BACKGROUND OF THE INVENTION

I. FIELD OF THE INVENTION

The present invention relates to variable compression ratio (VCR) piston assemblies such as those disclosed in U.S. Pat. Nos. 3,156,162; 3,161,112; 3,185,137; 3,185,138; 3,303,831; 3,311,096; 3,402,662; 3,418,982; 3,450,111; 3,417,738; 3,417,739; 3,450,112; 3,527,265; 3,405,698; 3,405,697; 3,405,113; 3,407,791; 3,667,433 and 3,704,695; all owned by Applicants' assignee and more particularly to an improved construction for such piston assemblies.

II. DESCRIPTION OF THE PRIOR ART

In the constructions disclosed in the patents indicated above an inner piston member is connected in the usual manner to a connecting rod and an outer piston member is carried by and is movable axially relative to the inner member. Relative movement of these members varies the compression ratio of the particular cylinder in which the piston moves. Clearance spaces are provided between the top and bottom ends of the inner and outer members and these form upper and lower chambers which vary conversely in volume in relation to the relative movement of the members. An incompressible fluid such as lubrication oil is supplied to these chambers in a manner which automatically regulates movement of the members to gradually change the compression ratio until a predetermined combustion pressure has been achieved. The hydraulic system then varies the movement of the members in a manner which tends to maintain a uniform maximum combustion chamber pressure.

Copending Application Ser. No. 611,863 discloses an improvement upon the assemblies disclosed and claimed in the aforementioned patents by providing a lightweight, inexpensive VCR piston constructed to minimize the effects of inertia on the discharge valve and to provide rapid response to variations in engine load.

SUMMARY OF THE INVENTION

The present invention provides a unique valve for regulating flow between the upper chamber and the lower chamber of the assembly. Although it will be described as a part of the assembly shown in copending application Ser. No. 611,863, it should be understood that it has utility in other assemblies including those illustrated in the aforementioned patents.

In the present invention, the lower oil chamber is connected to the upper chamber through a passage which extends through a groove provided for a sealing ring. The ring carried in the ring groove, in addition to performing its usual function, also acts as a check valve regulating the flow of oil from the upper chamber to the lower chamber in a manner which gradually increases the compression ratio of the engine until a predetermined maximum combustion chamber pressure has been achieved.

DESCRIPTION OF THE DRAWINGS

A better understanding of the present invention will be achieved upon reference to the following description which refers to the accompanying drawings in which like reference numerals refer to like parts throughout the several views and in which.

DESCRIPTION OF THE PREFERRED EMBODIMENT

Figure 2:
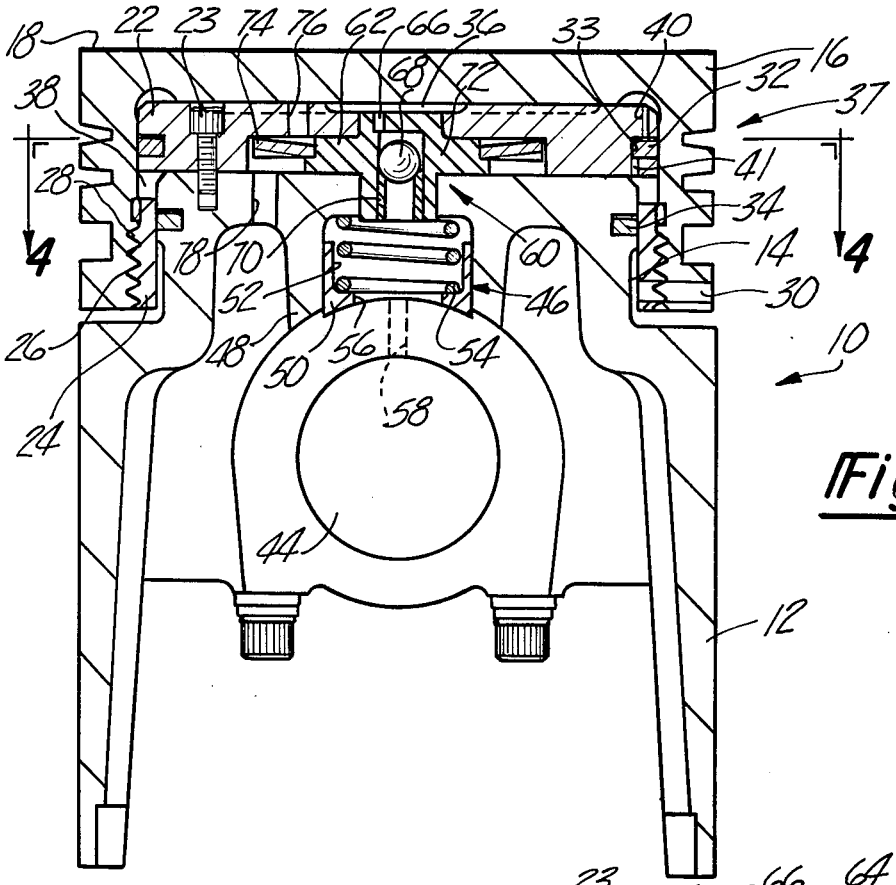
FIG. 2 is a view similar to FIG. 1 but illustrating the assembly in another operational position.

Now referring to the drawings for a more detailed description of the present invention a preferred variable compression ratio (VCR) piston 10 is illustrated as comprising an inner member 12 having a radially reduced upper section 14. An outer member 16 is mounted to the outer surface of the reduced section 14.

The outer member 16 has a crown 18 which serves as the head of the piston 10 and which forms a movable wall of the lower boundary of the combustion chamber of the engine. The outer member 16 is axially slidably mounted to the outer surface of the section 14 of the inner member 12.

Figure 3:
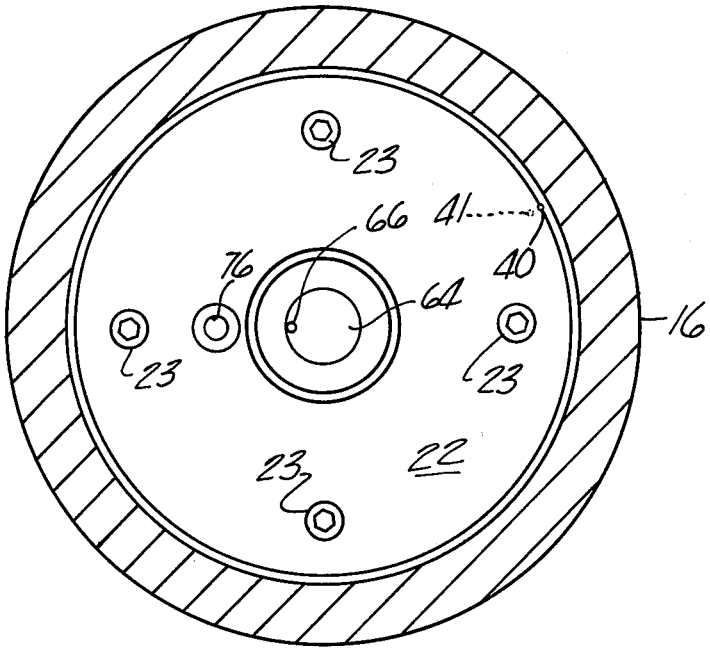
FIG. 3 is a cross-sectional view as seen substantially from line 3—3 of FIG. 1.

A plate 22 is mounted to the top of the inner member 12 preferably by bolts 23 (FIG. 3) and a ring 24 having external threads 26 is mounted to the outer member 16 by threads 28 formed on the inside surface of the lower portion of the outer member 16, the threaded joint 24 and 16 being only one preferred method of attachment. A lock means, such as a lock pin 30 holds the ring 24 in position. A sealing ring 32 carried by the plate 22 and a sealing ring 34 carried by the reduced section 14 of the inner member 12 engages the ring 24 to provide a fluid seal between the member seal between the members in the area of their sliding contact.

An upper chamber 36 is formed between the plate 22 and the inside surface of the crown 18. In addition a lower annular chamber 38 is formed between the lower edge of the plate 22, the outer member 16 and the ring 24 closely adjacent the ring groove area 37 of the piston 10.

Figure 5:
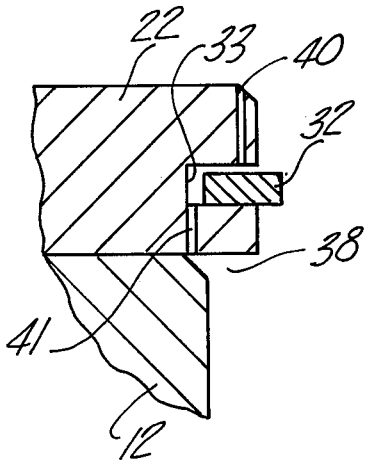
FIG. 5 is englarged view of a portion of the assembly shown in FIGS. 1 and 2.
Figure 4:
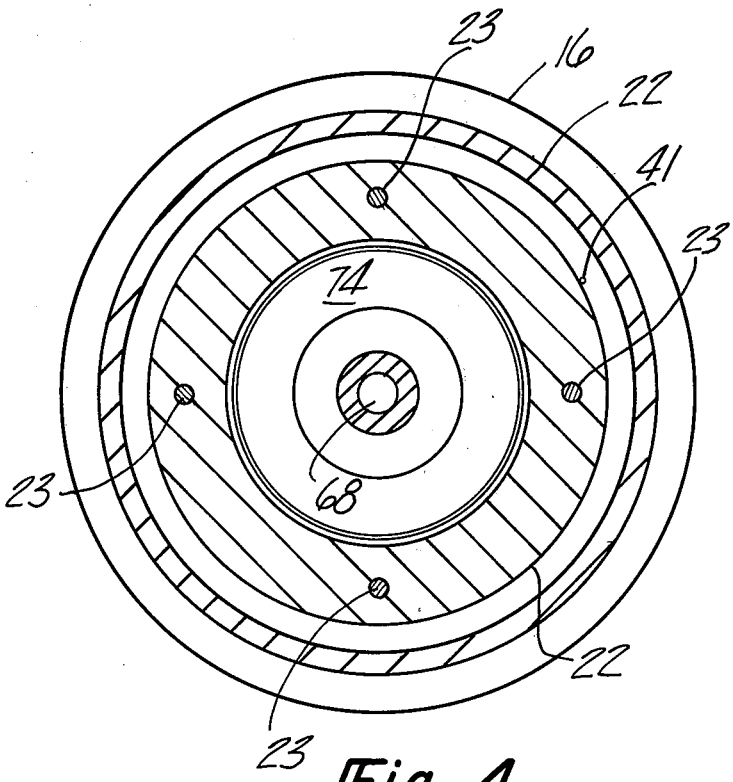
FIG. 4 is a cross-sectional view as seen substantially from line 4—4 of FIG. 2.

As can best be seen in FIG. 5, a passage 40 is formed in the plate 22 and connects the upper chamber 36 to a groove 33 which receives the sealing ring 32. A passage 41 is offset slightly from the passage 40 and connects the groove 33 to the lower chamber 38. The sealing ring 32 is carried in the groove 33 and is movable under the influence of inertia and oil pressure, in a manner which will become more apparent as the description proceeds, from the position shown in FIG. 5 wherein fluid flow is open between the passages 40 and 41 and a position in which the ring 32 rests against the upper surface of the groove 33 to block oil flow through the passage 40.

Figure 1:
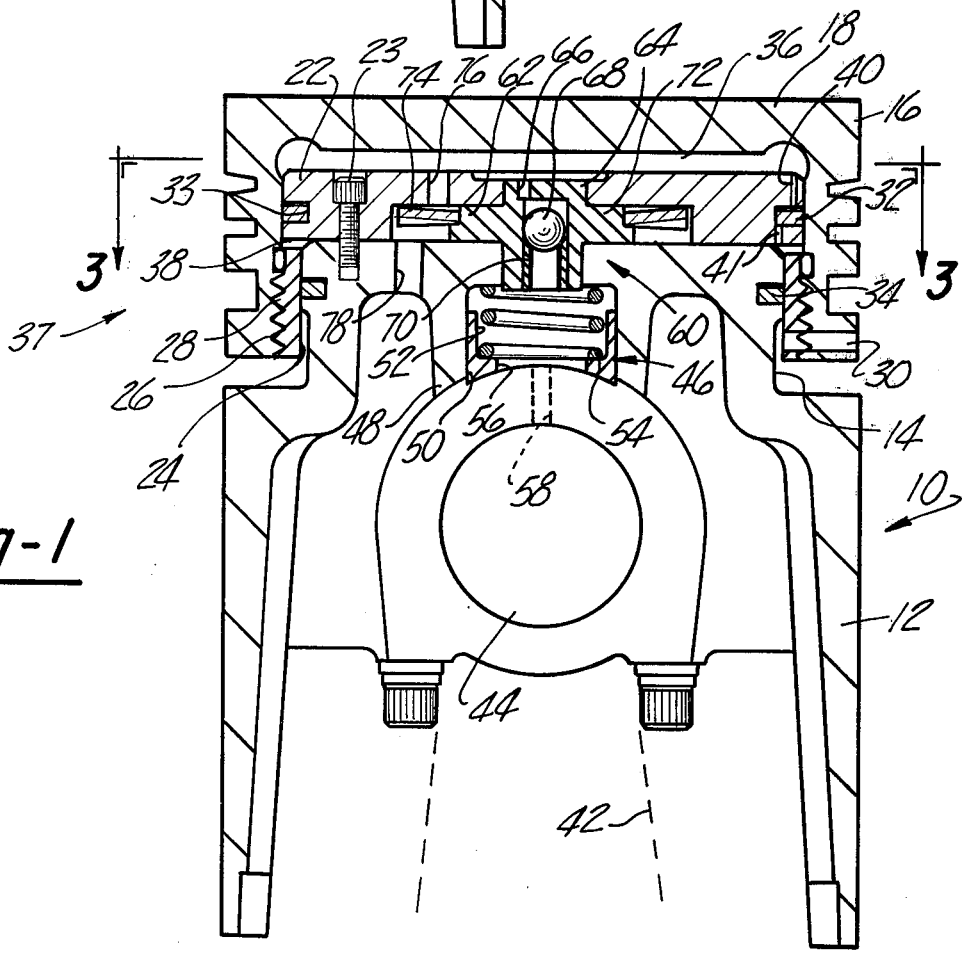
FIG. 1 is a longitudinal cross-sectional view of a piston assembly embodying a preferred construction of the present invention and illustrating the assembly in one operational position.

Referring again to FIGS. 1 and 2, the inner member 12 is connected to a connecting rod 42 by a piston pin 44 in the conventional manner of connecting engine pistons to a connecting rod. An oil collector assembly generally indicated at 46 is carried in a portion 48 of the inner member 12 and extends, downwardly into engagement with the top of the connecting rod 42. The collector assembly 46 preferably comprises an internally cored member 50 slidably carried in a recess 52 formed in the inner piston 12 and having a lower edge formed to conform to the upper surface of the connecting rod 42 so that as the connecting rod 42 pivots on the pin 44, and with respect to the inner member 12, the lower surface of the cap member 50 can conform tightly to the upper surface of the connecting rod 42. A spring 54 carried in the recess 52 urges the cap member 50 outwardly into engagement with the connecting rod 42.

The cap member 50 is provided with a central opening 56 which registers with an outlet passage 58 formed in the connecting rod 42. The passage 58 is connected with the lubrication system of the engine by means not shown.

A valve assembly 60 is carried in a chamber 62 formed in the plate 22 and includes a central substantially tubular portion 64 having a lower end extending through the upper portion of the inner member 12 to register with the recess 52. An upper end extends through the plate 22 and has a passage 66 opening to the upper chamber 36. A ball 68 is carried within the tubular portion 64 and is normally positioned on a seat 70 to block fluid flow through the tubular portion 64 to the passage 66 but is movable under pressure and inertia to a position opening such fluid flow.

A radially extending central portion 72 of the valve assembly 60 provides the means for carrying a tapered washer or Belleville spring type discharge valve 74 which in its closed position blocks flow from a passage 76 connected through the plate 22 to the upper chamber 36, to a passage 78 connected through the inner member 12 to the crankcase (not shown) of the engine.

As the invention has thus far been described it is apparent that the inner member 12, being connected to the connecting rod 42 in the conventional manner, moves up and down within the cylinder of an internal combustion engine within fixed limits and in the manner of a conventional piston. The outer member 16 reciprocates within the cylinder within the axial limits defined at its lower limit by the crown 18 engaging the top of the plate 22 and at its upper limit by the top of the ring 24 engaging the lower edge of the plate 22. Thus as the piston 10 reciprocates, the outer member 16 will tend to move under the influence of inertia toward the extreme uppermost and the extreme lowermost positions. The lubricant supplied to the chambers 36 and 38, however, regulates this movement in a manner to provide an increased compression ratio for the engine while at the same time maintaining a predetermined maximum combustion chamber pressure which is established by the opening pressure setting of valve 74.

This is accomplished by the inertia and oil pressure acting on the outer member 16 at the upper end of the exhaust stroke and the early part of the downward intake stroke causing the outer member 16 to separate from the inner member 12. As the members separate, the upper chamber 36 expands and the ball 68, which acts as a one way inlet valve, moves to a position to permit oil to be directed to the expanding chamber 36 from the passage 66. The ball 68 prevents the oil from passing back into the supply valve assembly 60 from the upper chamber 36 on the compression and downward stroke of the piston.

Likewise, as the piston moves upwardly, the sealing ring 32 will move to the position shown in FIG. 5 permitting oil to flow from the upper chamber 36 to the lower chamber 38. Reverse flow is prevented, however, during the downward stroke of the piston as inertia will cause the sealing ring 32 to move to a position closing fluid flow through the passage 40.

The result is that the piston assembly 10 will gradually be extended until a predetermined combustion chamber pressure has been achieved. This will, of course, result from the volume of the combustion chamber decreasing as the length of the piston assembly 10 is increased. When the combustion chamber pressure has reached the predetermined value, the pressure in the combustion chamber will be transmitted to the fluid in the upper chamber 36 to open the valve 74 and dump the oil in the chamber 36 to the crankcase.

There is sufficient leakage past the sealing ring 32 to permit the oil to escape from the lower chamber 38. A restricted orifice (not shown) could if preferred be provided to permit controlled leadage from the lower chamber 38.

The sealing ring 32 then provides an inexpensive check valve for regulating the flow of oil from the upper chamber 36 to the lower chamber 38.

While it has been preferred to illustrate the valve of the present invention in use in the assembly of our aforementioned patent application, it should be apparent that it can be used with other constructions and assemblies as well including those disclosed in the aforementioned patents.

It is also apparent that although we have described but one embodiment of our invention, many changes and modifications can be made therein without departing from the spirit of the invention as expressed by the scope of the appended claims.

We claim:

1. In an internal combustion engine, a piston having an inner member and an outer member telescopically received by said inner member, said members being movable in response to reciprocation of the piston with respect to a combustion chamber of the engine, a first fluid chamber and a second fluid chamber varying in volume in response to said relative movement and to variations in the quantity of fluid therein, means supplying fluid to said chambers, said means comprising a first passage in said piston connecting with said first fluid chamber, a one way inlet valve disposed in said first passage and a second passage in said piston connecting said first chamber with said second chamber, the improvement comprising a sealing groove in said inner member and a sealing member carried in said sealing groove, said second passage extending through said sealing groove and said sealing ring acting as a valve means to regulate fluid flow between said first and second chamber.

2. The invention as defined in claim 1 and in which said sealing member is movable in said sealing groove by inertia intermediate a position in which fluid flow is open through said second passage and a position in which fluid flow through said second passage is blocked.

3. The invention as defined in claim 2 in which said outer member terminates substantially short of the end of said inner member.

4. The invention as defined in claim 2 and in which said inner member has a reduced diameter section near the upper end thereof, and said outer member being disposed only around said reduced diameter section.

5. The invention as defined in claim 2 and in which said outer member is provided with a ring groove area and said second chamber is disposed adjacent said ring groove area.

6. The invention as defined in claim 4 and in which said first chamber is formed intermediate the upper end of said inner member and the upper end of said outer member, and said second chamber is formed adjacent the reduced diameter portion of said inner member.

7. The invention as defined in claim 2 and including a third passage connected with said first chamber and communicating with the crankcase of said engine, a normally closed valve disposed within said third passage and operable upon a predetermined pressure in said first chamber to open and thereby permit fluid to discharge from said first chamber.

8. The invention as defined in claim 7 and in which said valve is a tapered washer.

9. The invention as defined in claim 7 and in which said valve is a Belleville washer.

10. The invention as defined in claim 2 and including a plate carried at the upper end of said inner member, said fluid supplying means including valve means carried by said plate.

* * * * *